United States Patent [19]

Kane

[11] Patent Number: 5,075,595

[45] Date of Patent: Dec. 24, 1991

[54] FIELD EMISSION DEVICE WITH VERTICALLY INTEGRATED ACTIVE CONTROL

[75] Inventor: Robert C. Kane, Woodstock, Ill.

[73] Assignee: Motorola, Inc., Schaumburg, Ill.

[21] Appl. No.: 645,523

[22] Filed: Jan. 24, 1991

[51] Int. Cl.[5] ..... G09G 3/10

[52] U.S. Cl. ..... 315/169.1; 315/169.3; 315/169.4; 313/309; 313/336; 340/719; 340/720

[58] Field of Search ..... 315/169.1, 169.3, 169.4; 313/309, 336, 351; 340/718, 719, 720

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 4,006,383 | 2/1977 | Luo et al. | 340/718 |
| 4,020,381 | 4/1977 | Oess et al. | 313/309 |
| 4,721,885 | 1/1988 | Brodie | 313/576 |
| 4,827,177 | 5/1989 | Lee et al. | 313/306 |
| 4,874,981 | 10/1989 | Spindt | 313/309 |
| 4,904,989 | 2/1990 | Matsui et al. | 340/718 |
| 4,908,539 | 3/1990 | Meyer | 315/169.1 X |
| 4,940,916 | 7/1990 | Borel et al. | 313/306 |
| 5,012,153 | 4/1991 | Atkinson et al. | 313/336 |

FOREIGN PATENT DOCUMENTS

| | | |
|---|---|---|
| 0172089 | 7/1985 | European Pat. Off. . |
| 2604823 | 10/1986 | France . |
| 855782 | 8/1981 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986, IEDM.

Advanced Technology: Flat Cold-Cathode CRTs, by Ivor Brodie, Information Display 1/89.

Field-Emitter Arrays Applied to Vacuum Flourescent Display, by Spindt et al. Jan. 1989, Issue of IEEE Transactions on Electronic Devices.

Field Emission Cathode Array Development for High--Current Density Applications by Spindt et al., Dated Aug. 1982, vol. 16 of Applications of Surface Science.

*Primary Examiner*—Eugene R. Laroche
*Assistant Examiner*—Son Dinh
*Attorney, Agent, or Firm*—Darleen J. Stockley

[57] ABSTRACT

An electronic device employing controlled cold-cathode field-induced electron emission device(s) is set forth wherein controlling sources, drivers, select logic, and interconnecting lines and paths are integrated directly within a single structure.

59 Claims, 4 Drawing Sheets

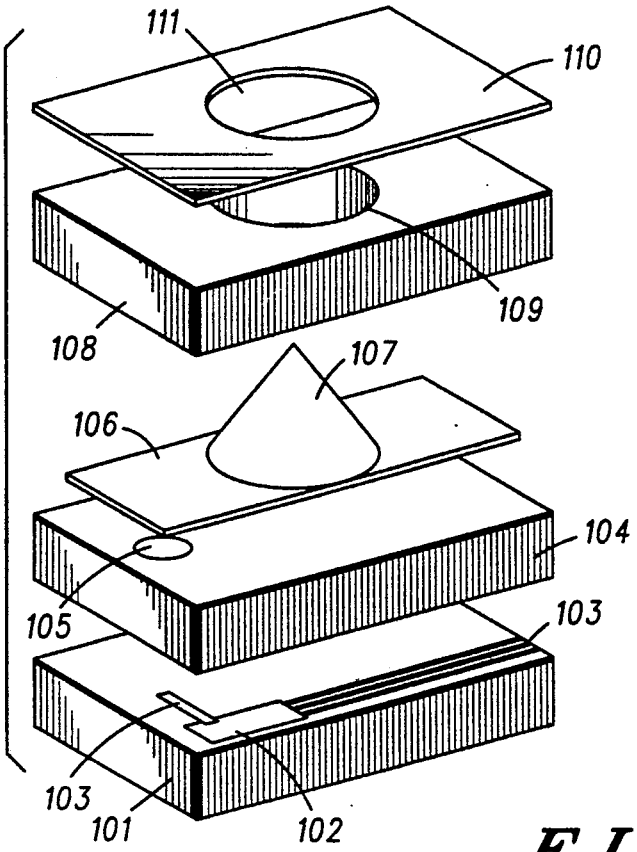
FIG. 1
FIG. 3
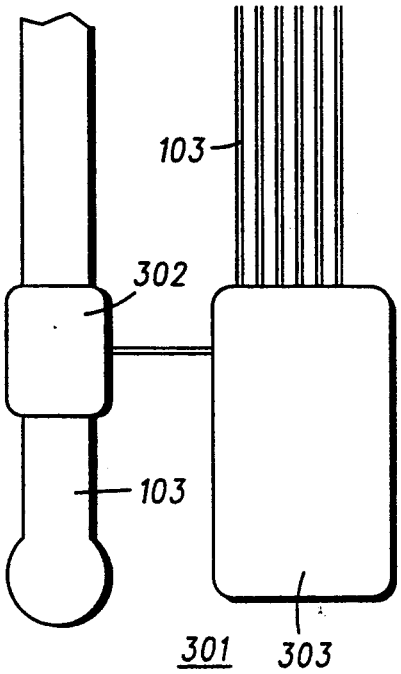

FIELD EMISSION DEVICE WITH VERTICALLY INTEGRATED ACTIVE CONTROL

TECHNICAL FIELD

This invention relates generally to field-induced electron emission devices, and more particularly, to actively controlled cold-cathode field-induced electron emission devices.

BACKGROUND OF THE INVENTION

Cold-cathode field-induced electron emission devices (FEDs) are known in the art. FEDs typically employ an emitter or emitters, for emitting electrons directly into a vacuum or other non-condensed matter environment. The electron emission is generally induced by applying an appropriate electric field to the emitter(s) at a region which exhibits a geometric discontinuity of small radius of curvature. The geometric discontinuity will provide for enhancement of the applied electric field, and, under correct circumstances, will permit tunnelling of electrons from the surface of the emitter. The required electric field may be provided by applying a potential to a suitable anode, gate electrode, or directly to the emitter.

It is desirable to actively control electron emission of single FEDs and arrays of many FEDs. Typically, current sources and/or voltage sources may be utilized to employ FEDs in a manner that yields a desired electron emission. Some prior art embodiments of FED control demonstrate that a means for actively modulating emission of FEDs, whether individually or in groups, must be constructed discretely and must be coupled to interconnecting lines within the FED structure. However, no device configuration exists which provides for placing active electron emission modulating and control circuitry directly within a same structure in which an FED or array of FEDs resides.

Accordingly, there exists a need for FED structures which provide for integral incorporation of active electron emission modulating networks and FED driving sources.

SUMMARY OF THE INVENTION

This need and others are substantially met through provision of an electronic device in accordance with the present invention, comprising at least: a controlled cold cathode field-induced electron emission device (FED) that comprises at least: a supporting substrate with at least a first major surface; a current source substantially disposed in the supporting substrate; a first insulator layer comprised of at least a first and a second surface, wherein at least part of the at least first surface of the first insulator layer is disposed on at least part of the at least first major surface of the supporting substrate, the at least first insulator layer having at least a first conductive path that is operably coupled to the current source and that is disposed transversely through the said first insulator layer; an electron emitter, for emitting electrons, at least partially disposed on the at least second surface of the first insulator layer and operably coupled to the at least first conductive path; and an anode, distally disposed with respect to the electron emitter, for collecting at least some of the emitted electrons.

BRIEF DESCRIPTION OF THE DRAWINGS

FIG. 1 is an expanded perspective depiction of a first embodiment of a controlled FED in accordance with the present invention.

FIG. 3 is a top plan depiction of a current source and current source driver and select logic network with interconnecting conductive lines in accordance with the present invention.

DETAILED DESCRIPTION OF A PREFERRED EMBODIMENT

Figure 2:
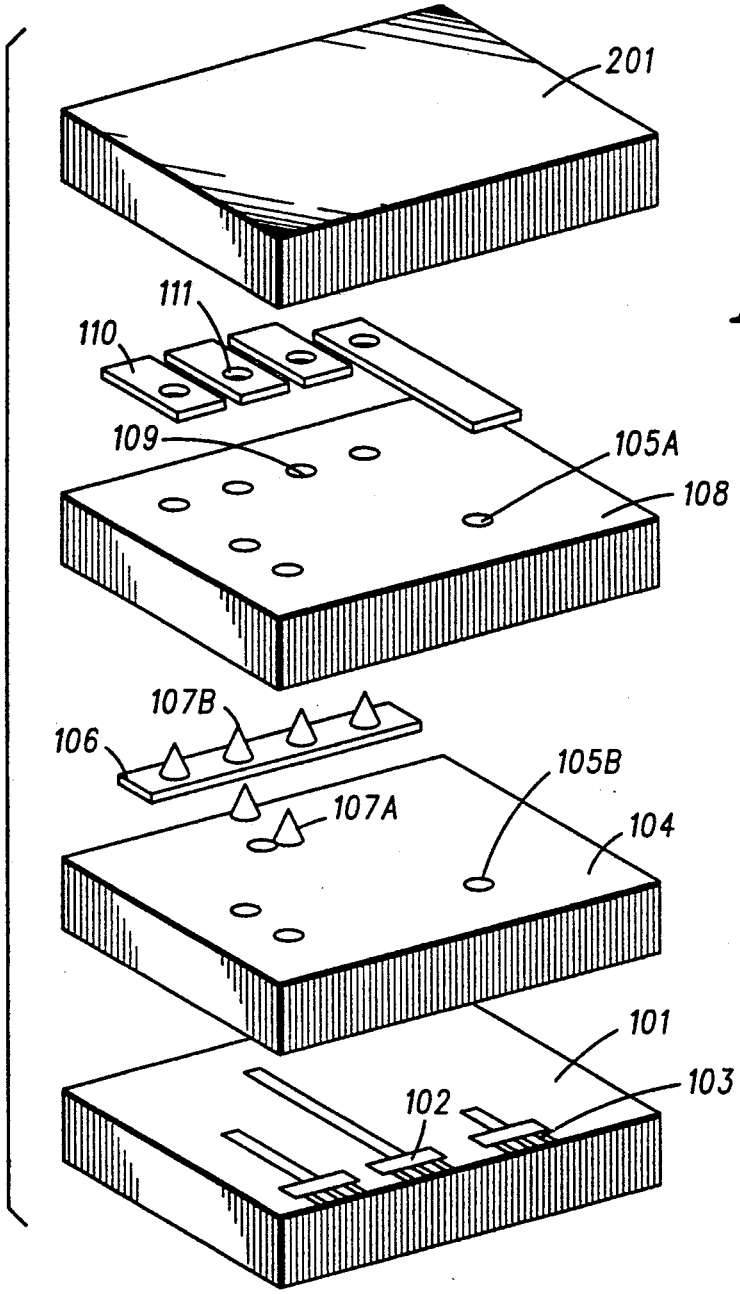
FIG. 2 is an expanded perspective depiction of various additional embodiments of controlled FEDs in accordance with the present invention.

FIG. 1 illustrates an expanded perspective of a first embodiment of a controlled FED structure in accordance with the present invention, depicting a supporting substrate (101) in which at least a partly active and, if desired, partly passive, controlling electronic network (102) has been formed. The controlling electronic network (102) typically comprises active networks comprised of desired combinations of current sources, voltage sources, current source driver and select logic networks, and/or voltage source driver and select logic networks, which active networks may further include passive components as required to achieve a desired circuit operation. Current sources, voltage sources, current source driver and select logic networks, and voltage source drivers and select logic networks are well known and understood in the art, and thus will not be further described herein. Any preferred configuration of these sources and networks may be employed to obtain a desired electronic device in accordance with the present invention.

The controlling electronic network (102) is connected to an external environment and to FED electrodes by coupling the controlling electronic network (102) to at least a first conductive line (103) formed in/on the supporting substrate (101). At least a first conductive line (103) is typically formed in the supporting substrate (101) by a known technique including, but not limited to, ion implantation and impurity diffusion. Alternatively, the at least first conductive line (103) is also formed on the supporting substrate (101) by known deposition techniques, including, but not limited to, sputtering and evaporation.

Typically, subsequent to providing the controlling electronic network (102) and at least first conductive line (103) on/in the supporting substrate (101), at least a first insulator layer (104) is disposed substantially planarly parallel to the supporting substrate, such that at least a first surface of the at least first insulator layer (104) is in contact with at least a first major surface of the supporting substrate (101) on/in which the controlling electronic network (102) and at least first conductive line (103) are positioned. At least a first conductive path (105) is formed in the at least first insulator layer (104) by known etch and deposition techniques such that the at least first conductive path (105) traverses a thickness of the at least first insulator layer (104) in a substantially transverse manner with respect to the first surface of the at least first insulator layer, and also such that the at least first conductive path (105) operably couples the at least first conductive path (105) to at least a first conductive line (103).

FIG. 1 also depicts at least a first non-insulator layer (106) that, where desired, is typically disposed on a second surface of the at least first insulator layer (104), and is operably coupled to the at least first conductive path (105). An electron emitter (107) is further depicted, being disposed substantially on the at least first non-insulator layer (106). So constructed, the controlling electronic network (102) that resides in the supporting substrate (101) is operably coupled through the at least first intervening conductive line (103) and the at least first conductive path (105), and provides control of electron emission from the electron emitter (107). The non-insulator layer (106) is typically comprised of metallic/semiconductive material.

FIG. 1 further depicts at least a second insulator layer (108) which contains at least a first aperture (109), the at least second insulator layer, if desired, being disposed on at least part of the at least second surface of the at least first insulator layer (104). The at least second insulator layer (108) is substantially disposed on at least part of the at least first non-insulator layer (106), and is configured so that the electron emitter (107) will be substantially symmetrically disposed within the at least first aperture (109) of the at least second insulator layer. Where desired, a gate electrode (110), shown with at least a first gate aperture (111) that substantially corresponds to the at least first aperture (109) in the second insulator layer (108), is generally disposed on at least a part of the at least second surface of the at least second insulator layer (108).

It is immediately apparent, where reference is made to a layer in the singular, that multiple deposition and oxide growth techniques may be employed to yield the embodiment described, and that such techniques are clearly within the scope of this invention.

FIG. 2 sets forth an expanded perspective depiction of a controlled FED that has a plurality of controlling networks (102) and FED configurations within the confines of a single structure in accordance with the present invention. FIG. 2 depicts an embodiment wherein a supporting substrate (101) has a plurality of controlling electronic networks (102), at least a first of which is operably coupled to at least a first conductive line (103) of a plurality of conductive lines. As with the previously described embodiment, the plurality of conductive lines may be formed wholly/partially in/on the supporting substrate (101). Also, as with the previously described embodiment, the controlling electronic networks (102) are typically comprised of selected combinations of current sources, voltage sources, current source driver and select logic networks, and voltage source driver and select logic networks.

At least a first insulator layer (104) is shown, including, in this embodiment, a plurality of conductive paths (105B). The at least first insulator layer is substantially disposed planarly parallel with respect to, and substantially in contact with, at least a first major surface of the supporting substrate (101) in/on which the controlling electronic networks (102) and plurality of conductive lines (103) are positioned. Typically, at least some of the plurality of conductive paths (105B) are operably coupled to at least some of the plurality of conductive lines (103).

FIG. 2 further depicts a plurality of electron emitters (107A, 107B), some of which (107A) are shown substantially disposed on the at least second surface of the first insulator layer (104) and are operably connected to at least a first conductive path (105B) of the plurality of conductive paths, and some of which (107B) are depicted as residing on at least a first non-insulator layer (106), which at least first non-insulator layer (106) is substantially disposed on the at least second surface of the at least first insulator layer (104), and which at least first non-insulator layer (106) is operably coupled to at least a conductive path of the plurality of conductive paths (105B). Where desired, an at least second insulator layer (108), having at least a first and a second surface, is utilized, wherein a plurality of apertures (109) are formed and further including, as depicted, an at least first conductive path (105A). The at least second insulator layer, where desired, is typically disposed substantially planarly parallel with respect to, and substantially in contact with, the second surface of the at least first insulator layer (104) and with a surface of the at least first non-insulator layer (106), and is typically configured so that the electron emitters (107) will be disposed substantially symmetrically within the apertures (109) of the at least second insulator layer (108). The at least first conductive path (105A) in the at least second insulator layer (108) is formed as described previously, and is operably coupled to an at least a conductive path of the plurality of conductive paths (105B) in the at least first insulator layer (104). Subsequently, at least a second non-insulator layer, if desired, is selectively patterned and disposed on at least the second surface of the second insulator layer (108) to effect a pattern of gate electrodes (110) in which gate apertures (111) are formed. In this embodiment, at least a first of the plurality of gate electrodes (110) is substantially operably coupled to the at least first conductive path (105A) that is positioned in the at least second insulator layer (108). So coupled, the at least first of the plurality of gate electrodes (110) is substantially controlled by a controlling electronic network residing in the underlying supporting substrate (101). Utilization of a selected voltage source and voltage source driver and select logic network provides for integral control of the at least first coupled gate electrode (110) to induce/inhibit electron emission at those electron emitters (107B) associated with the at least first gate electrode (110). In one embodiment, illustrated in FIG. 2, some of the plurality of gate electrodes (110) are not operably coupled to conductive paths (105A, 105B) of the controlling electronic network, illustrating provision for external control/switching of the present invention. As desired, external control may also be utilized together with internal controlling electronic networks (102) as described above.

FIG. 2 shows selected configurations for effecting control of FEDs by operably coupling current sources and/or voltage sources to selected electrodes/arrays of FEDs and utilizing desired drivers and select logic networks, all of which are, if desired, incorporated in the supporting substrate layer (101), to induce/inhibit/modulate electron emission from the FED/array of FEDs. The structure of FIG. 2 further depicts an anode (201) distally disposed with respect to the electron emitters (107A, 107B) to collect at least some of any emitted electrons.

FIG. 3 sets forth a top plan depiction of a current source and current source driver and select logic network with interconnecting conductive lines in accordance with the present invention, illustrating an embodiment of a controlling electronic network comprising a current source (302) and a current source driver and select logic network (303), each of which is selectively operably coupled to some of a plurality of conductive lines (103), all of which are substantially disposed in/on a layer of semiconductor material (301) that, as desired, functions as the supporting substrate layer/intervening layer of an FED structure. The layer of semiconductor material (301) may be formed by any known methods, including, but not limited to: deposition of amorphous-/poly-silicon, epitaxial layer growth, and/or buried oxide layer implantation.

Figure 4:
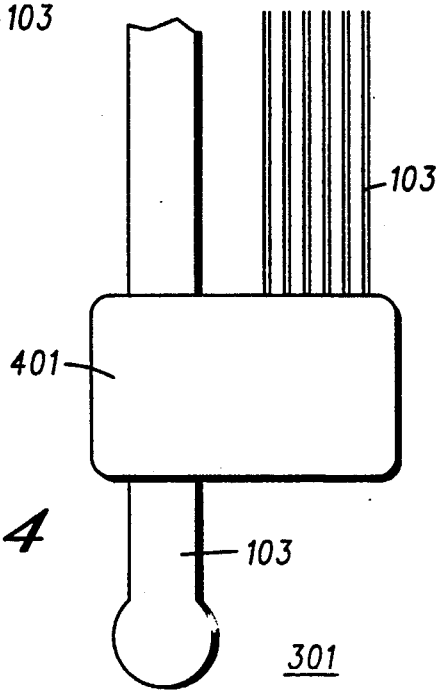
FIG. 4 is a top plan depiction of a voltage source with voltage source driver and select logic network and interconnecting conductive lines in accordance with the present invention.

FIG. 4 sets forth a top plan depiction of a voltage source with voltage source driver and select logic network (401) and interconnecting conductive lines (103), illustrating one embodiment of a controlling electronic network of an FED in accordance with the present invention. The voltage source and voltage source driver and select logic (401) is selectively operably coupled to at least a first of a plurality of conductive lines (103), all of which are disposed in/on a layer of semiconductor material (301) that, as desired, functions as the supporting substrate layer/intervening layer of an FED structure. Again, the layer of semiconductor material (301) may be formed by any known methods including, but not limited to: deposition of amorphous-/poly-silicon, epitaxial layer growth, and/or buried oxide layer implantation.

Figure 5A:
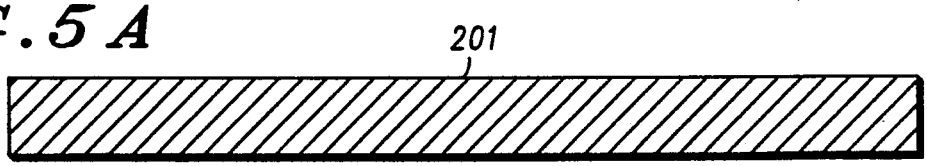
FIG. 5 is an expanded (A–F) side elevational cutaway view of a first particular structure employing a first selected group of embodiments of controlled FEDs in accordance with the present invention.
Figure 5B:
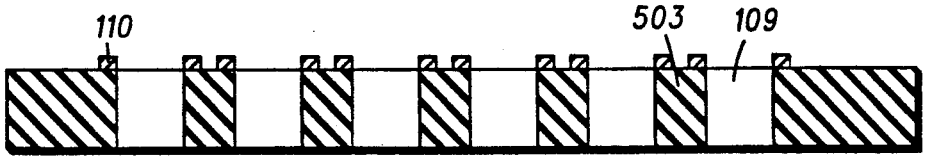
Figure 5C:
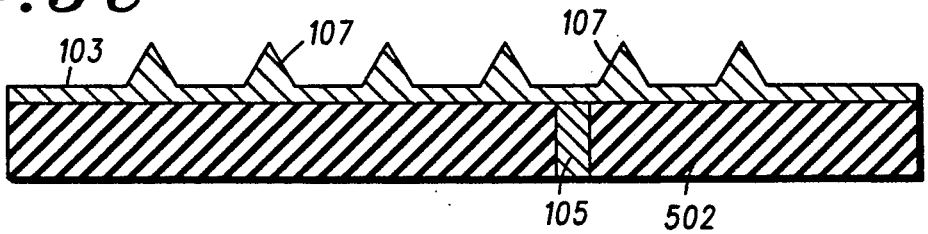
Figure 5D:
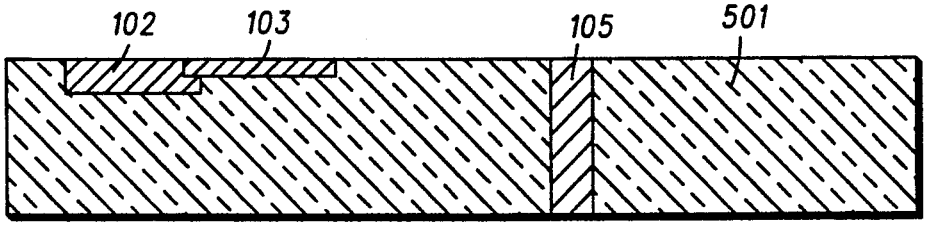
Figure 5E:
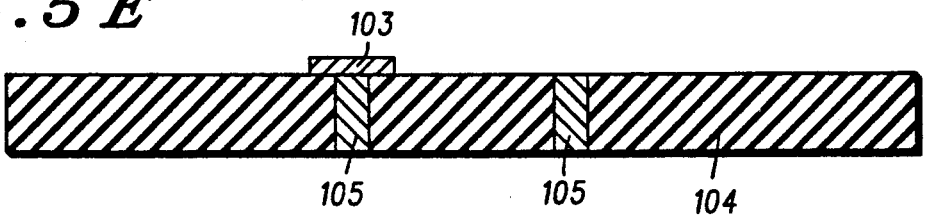
Figure 5F:
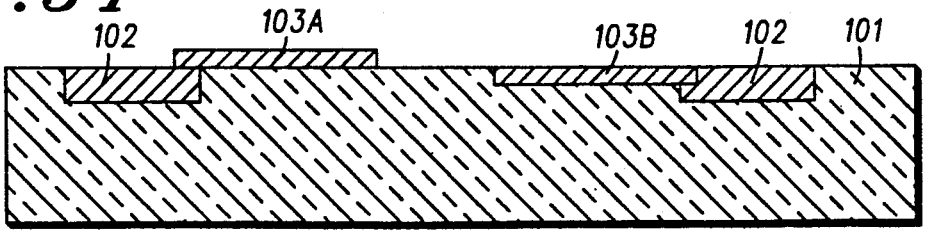
Figure 6A:
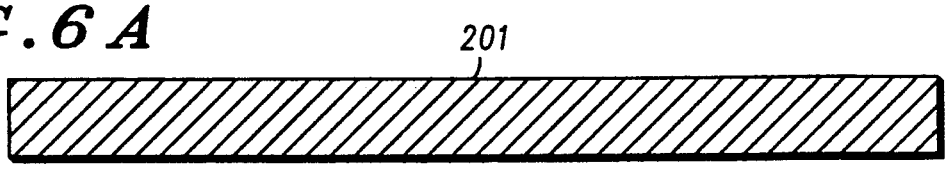
FIG. 6 is an expanded (A–F) side elevational cutaway view of a second particular structure employing a second selected group of embodiments of controlled FEDs in accordance with the present invention.
Figure 6B:
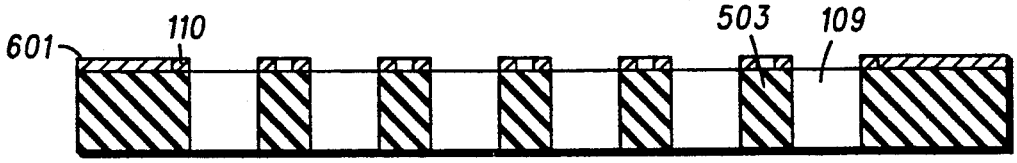
Figure 6C:
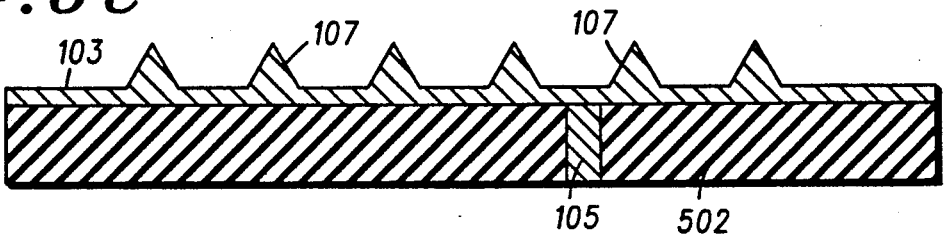
Figure 6D:
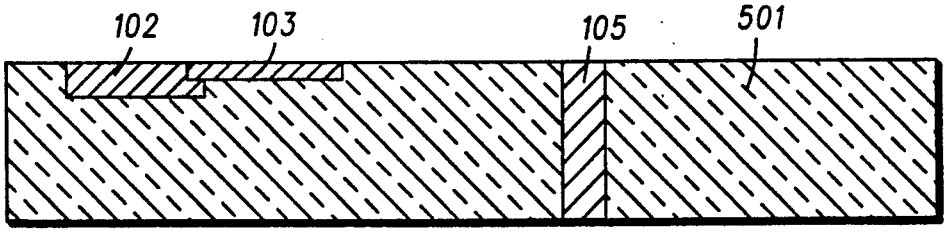
Figure 6E:
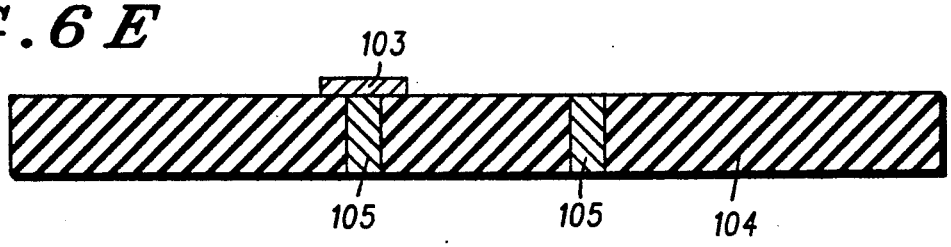
Figure 6F:
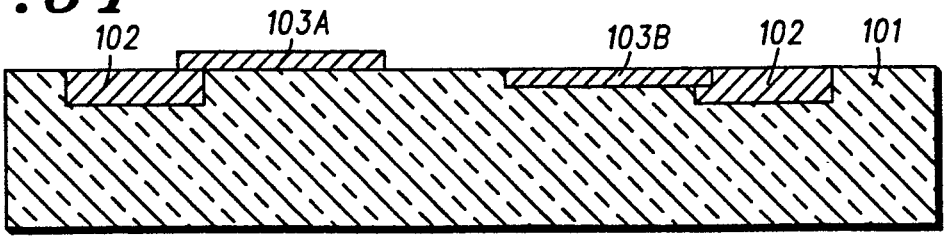

FIG. 5 depicts an expanded (A–F) side elevational cutaway view of a first particular structure employing a first selected group of embodiments of controlled FEDs in accordance with the present invention, FIG. 5F illustrating a supporting substrate (101) in which resides controlling electronic networks (102) that may be configured as current sources, voltage sources, current source driver and select logic networks, voltage source driver and select logic networks, as well as any desired combinations of all of these so as to perform required control functions of a particular application. At least a first conductive line of a plurality of conductive lines (103A, 103B) is positioned on/in the at least first major surface of the supporting substrate (101) associated with the controlling electronic networks (102). In this embodiment at least a first selected conductive line of the plurality of conductive lines is disposed on/in (103A/103B) the supporting substrate (101).

FIG. 5 further depicts, FIG. 5E, at least a first insulator layer (104), having at least a first and a second surface, in which at least a first of a plurality of conductive paths (105) has been formed. The at least first insulator layer (104) is disposed substantially planarly parallel with respect to, and having at least a first surface disposed substantially on, the at least first major surface of the supporting substrate (101) that includes at least a first control electronic network (102) and at least a first conductive line of the plurality of conductive lines. At least a first conductive path of the conductive paths (105) operably couples to at least a first conductive line of the plurality of conductive lines (103A, 103B) that are disposed on/in the supporting substrate (101). An additional plurality of conductive lines (103) may be provided on the second surface of the first insulator layer (104), as shown, as well as on any subsequent non-insulator layers, insulator layers, or semi-conductor layers.

FIG. 5D depicts an intervening semiconductor layer (501) that has at least a first and a second surface, and is typically disposed substantially planarly parallel with respect to the at least first insulator layer (104), and is further disposed such that the at least first surface of the at least second semiconductor layer (501) is substantially disposed on the at least second surface of the first insulator layer (104). The second semiconductor layer (501) also comprises at least a first conductive path of the plurality of conductive paths (105), at least a first integral controlling electronic network (102), and at least a first conductive line (103). The at least first conductive path (105) is substantially disposed in the at least second semiconductor layer, selectively located to operably couple to other selected conductive paths/conductive lines (105/103) associated with other layers of the FED structure. Although FIG. 5 shows a plurality of semiconductor layers in which control electronics are disposed, it is clear that embodiments employing more than two such layers for increased integration and control density are also within the scope of the present invention.

FIG. 5 further depicts, FIG. 5C, a second insulator layer (502) that also includes at least a first conductive path of the plurality of conductive paths (105). The second insulator layer (502) typically includes at least a first and a second surface and is typically disposed substantially planarly parallel with respect to, and with the first surface substantially on, the at least second surface of the second semiconductor layer (501). A plurality of conductive lines (103) is generally disposed on the at least second surface of the second insulator layer (502) wherein at least a first conductive line of the plurality of conductive lines (103) is operably coupled to at least a first conductive path of the plurality of conductive paths (105). Electron emitters (107) are disposed substantially on at least a first conductive line of the plurality of conductive lines (105). Thus, electron emitters are effectively controlled by underlying controlling electronic networks (102) that are coupled through at least an intervening conductive line (103) of the plurality of conductive lines and at least a first conductive path of the plurality of conductive paths (105).

FIG. 5 further illustrates, FIG. 5B, at least a third insulator layer (503), having at least a first and a second surface, that includes a plurality of apertures (109), as described earlier with reference to FIGS. 1 and 2, and is typically disposed planarly parallel with respect to, and with the first surface of the third insulator layer (503) at least partially on the second insulator layer (502). A non-insulator layer, selectively formed as a plurality of gate electrodes (110) is generally disposed on part of the at least second surface of the at least third insulator layer (503). An anode (201), depicted in expanded portion A of FIG. 5, is distally disposed with respect to the electron emitters (107) to collect at least some of any emitted electrons. Further, the gate electrodes (110) may be operably coupled to at least a first conductive path (not shown) in a manner substantially similar to that previously described with reference to FIG. 2, to effectively control a potential applied to the gate electrodes (110) by utilizing the at least first integral control electronics networks (102) residing in underlying layers.

FIG. 6 depicts an expanded (A-F) side elevational cutaway view of a second particular structure employing a second selected group of embodiments of controlled FEDs in accordance with the present invention, including a semiconductor layer (601) disposed substantially on at least part of the at least second surface of the at least third insulator layer (503): At least a first gate electrode or a selectively patterned plurality of gate electrodes (110) may be formed by selective impurity doping of the semiconductor layer (601). The selectively doped regions of the semiconductor layer (601) that comprise the gate electrode(s) (110) are, where desired, further selectively operably coupled to at least a first conductive path (not shown) to effect integral control by selected controlling electronic networks (102). Alternatively, as desired, external controlling electronic networks are utilized, as previously described, to act alone/in concert with other integral controlling electronic networks (102).

Pursuant to this invention a controlled FED is provided wherein electron emission may be induced, modulated, switched, and routed as directed by active controlling networks that reside within an integrated structure that further includes the FED/FEDs upon which control is being exercised. These active controlling networks are conveniently formed within a supporting substrate, where the supporting substrate is, if desired, a semiconductor material, and/or additional semiconductor layers. Interconnections between layers of a multilayer structure are made by employing conductive paths that traverse thicknesses of individual layers and effectively couple electrodes of the FED/array of FEDs utilizing conductive lines and emission controlling active networks.

In one embodiment of the invention, a controlled FED is provided wherein a current source or multiplicity of current sources is(are) formed in the supporting substrate layer and subsequently coupled to selected emitter(s) of the device through conductive lines which have been deposited on or in the various layers of the structure, and further coupled through the conductive paths through the intervening layers.

In another embodiment of the invention, a structure similar to that of the previously described embodiment further includes one or more current source driver and select logic networks to provide an enhanced level of integral control to the FED.

In another embodiment of the invention, the various current sources and current source driver and select logic networks are disposed in intervening layers of semiconductor material as well as, if desired, in/on the supporting substrate. As with embodiments described above, the controlling networks are conveniently interconnected, as desired, to each other and to selected electrodes of individual FEDs/groups of FEDs by operably coupling the controlling networks and FEDs to at least a first of a plurality of conductive lines and, if desired, to at least a first conductive path.

Additional combinations of integrally formed current sources, voltage sources, current source driver and select logic networks, and voltage source driver and select logic networks may be employed to achieve controlled FED operation in accordance with the present invention including utilization a greater number of insulator layers, semiconductor layers, and non-insulator layers, as desired, to provide embodiments with increased control integration.

The present invention sets forth vertically integrated active control for FED structures to induce/inhibit/modulate electron emission from the FED/array of FEDs in an efficient manner, thereby yielding a preferred FED structure that is compact and highly suitable for radio frequency and microwave devices, television, and numerous other electronic devices.

I claim:

1. A controlled cold-cathode field-induced electron emission device (FED) comprising at least:

A) a supporting substrate with at least a first major surface;

B) a current source substantially disposed in the supporting substrate;

C) a first insulator layer comprised of at least a first and a second surface, wherein at least part of the at least first surface of the first insulator layer is disposed on at least part of the at least first major surface of the supporting substrate, the at least first insulator layer having at least a first conductive path that is operably coupled to the current source and that is disposed transversely through the said first insulator layer;

D) an electron emitter, for emitting electrons, at least partially disposed on the at least second surface of the first insulator layer and operably coupled to the at least first conductive path; and E) an anode, distally disposed with respect to the electron emitter, for collecting at least some of the emitted electrons.

2. The controlled cold-cathode field-induced electron emission device of claim 1, further comprising a plurality of electron emitters, each of which is at least partially disposed on the at least second surface of the first insulator layer, wherein at least a first of the plurality of electron emitters is operably coupled to the at least first conductive path.

3. The controlled cold-cathode field-induced electron emission device of claim 1, further comprising a plurality of conductive lines disposed on part of the at least first major surface of the supporting substrate, wherein at least some of the plurality of conductive lines are operably coupled to the current source.

4. The controlled cold-cathode field-induced electron emission device of claim 1, further comprising a plurality of conductive lines, at least some of which are disposed substantially in the supporting substrate and at least some of which are operably coupled to the current source.

5. The controlled cold-cathode field-induced electron emission device of claim 1, further comprising a plurality of conductive lines substantially disposed on at least part of the at least second surface of the first insulator layer, wherein at least some of the plurality of conductive lines are operably coupled to the at least first conductive path.

6. The controlled cold-cathode field-induced electron emission device of claim 1, further comprising:

A) at least a first conductive line disposed substantially on at least part of the at least second surface of the first insulator layer, wherein the at least first conductive line is operably coupled to the at least first conductive path; and B) at least a second conductive line disposed substantially on at least part of the at least first major surface of the supporting substrate, wherein the at least second conductive line is operably coupled to the current source.

7. The controlled cold-cathode field-induced electron emission device of claim 1, and further comprising:

A) at least one conductive line substantially disposed on at least a part of the second surface of the first insulator layer, and wherein at least one conductive line of the at least one conductive line is operably coupled to at least one of the at least one conductive path; and B) at least one conductive line disposed substantially in the supporting substrate and wherein at least one of the at least one conductive line is operably coupled to the current source.

8. The controlled cold-cathode field-induced electron emission device of claim 1, further comprising at least:

A) a second insulator layer substantially disposed on at least part of the at least second surface of the first insulator layer; and B) a non-insulating gate electrode layer substantially disposed on at least part of the at least second insulating layer and substantially peripherally symmetrically disposed about the electron emitter.

9. A controlled cold-cathode field-induced electron emission device (FED) comprising at least:

A) a supporting substrate with at least a first major surface;

B) a voltage source substantially disposed in the supporting substrate;

C) a first insulator layer comprised of at least a first and a second surface, wherein at least a part of the at least first surface of the first insulator layer is disposed on at least part of the at least first major surface of the supporting substrate, the at least first insulator layer having at least a first conductive path, which at least first conductive path is operably coupled to the voltage source, and is disposed transversely through the said first insulator layer;

D) an electron emitter, for emitting electrons, at least partially disposed on the at least second surface of the insulator layer and operably coupled to at least the first conductive path; and E) an anode, distally disposed with respect to the electron emitter, for collecting at least some of the emitted electrons.

10. The controlled cold-cathode field-induced electron emission device of claim 9, further comprising a plurality of electron emitters, each of which is at least partially disposed on the at least second surface of the first insulator layer and wherein at least a first of the plurality of electron emitters is operably coupled to at least a first conductive path.

11. The controlled cold-cathode field-induced electron emission device of claim 9, further comprising a plurality of conductive lines substantially disposed on part of the at least first major surface of the supporting substrate, wherein at least some of the plurality of conductive lines are operably coupled to the voltage source.

12. The controlled cold-cathode field-induced electron emission device of claim 9, further comprising a plurality of conductive lines, at least some of which are disposed substantially in the supporting substrate and at least some of which are operably coupled to the voltage source.

13. The controlled cold-cathode field-induced electron emission device of claim 9, further comprising a plurality of conductive lines substantially disposed on at least part of the at least second surface of the first insulator layer, wherein at least some of the plurality of conductive lines are operably coupled to at least the first conductive path.

14. The controlled cold-cathode field-induced electron emission device of claim 9, further comprising:

A) at least a first conductive line disposed substantially on at least part of the at least second surface of the first insulator layer, wherein at least the first conductive line is operably coupled to the at least first conductive path; and B) at least a second conductive line disposed substantially on at least part of the at least first major surface of the supporting substrate, wherein the at least second conductive line is operably coupled to the voltage source.

15. The controlled cold-cathode field-induced electron emission device of claim 9, further comprising:

A) at least a first conductive line substantially disposed on at least part of the at least second surface of the first insulator layer, wherein at least the first conductive line is operably coupled to at least the first conductive path; and B) at least a second conductive line disposed substantially in the supporting substrate, wherein the at least second conductive line is operably coupled to the voltage source.

16. The controlled cold-cathode field-induced electron emission device of claim 9, and further comprising:

A) a second insulator layer substantially disposed on at least part of the at least second surface of the first insulating layer; and B) a non-insulating gate electrode layer substantially disposed on at least part of the at least second insulating layer and substantially peripherally symmetrically disposed about the electron emitter.

17. A controlled cold-cathode field-induced electron emission device (FED) comprising at least:

A) a supporting substrate with at least a first major surface;

B) a current source substantially disposed in the supporting substrate;

C) an plurality of conductive lines, at least some of which are operably coupled to the current source and are disposed on part of the least first major surface of the supporting substrate;

D) a first insulator layer comprised of at least a first and a second surface, wherein at least part of the at least first surface of the first insulator layer is disposed on at least part of the at least first major surface of the supporting substrate, the first insulator layer having at least a first conductive path that is operably coupled to at least a first conductive line of the plurality of conductive lines and is disposed transversely through the said first insulator layer;

E) a first non-insulator layer substantially disposed on at least part of the at least second surface of the first insulator layer and operably coupled to at least the first conductive path;

F) an electron emitter, for emitting electrons, at least partially disposed on the non-insulator layer;

G) a second insulator layer comprised of at least a third and a fourth surface, the second insulator layer having an aperture substantially transversely disposed through the second insulator layer, wherein at least the third surface of the second insulator layer is at least partially disposed on the non-insulator layer and is positioned such that the electron emitter is symmetrically disposed within the aperture; and H) a gate electrode comprised of a second non-insulator layer substantially disposed on at least part of the second surface of the second insulator layer.

18. The controlled cold-cathode field-induced electron emission device of claim 17, further comprising an anode, distally disposed with respect to the electron emitter, for collecting at least some of the emitted electrons.

19. A controlled cold-cathode field-induced electron emission device (FED) comprising at least:

A) a supporting substrate with at least a first major surface;

B) a voltage source substantially disposed in the supporting substrate;

C) a plurality of conductive lines, at least some of which are operably coupled to the voltage source and at least some of which are disposed on part of the at least first major surface of the supporting substrate;

D) a first insulator layer comprised of at least a first and a second surface, wherein at least part of the at least first surface of the first insulator layer is disposed on at least part of the at least first major surface of the supporting substrate, the first insulator layer having at least a first conductive path that is operably coupled to at least a first conductive line of the plurality of conductive lines and is disposed transversely through the said first insulator layer;

E) a first non-insulator layer substantially disposed on at least part of the at least second surface of the first insulator layer and operably coupled to at least the first conductive path;

F) a first electron emitter, for emitting electrons, at least partially disposed on the first non-insulator layer;

G) a second insulator layer comprised of at least a third and fourth surface, the second insulator having an aperture substantially transversely disposed through the second insulator layer, wherein at least the third surface of the second insulator layer is at least partially disposed on the first non-insulator layer and is positioned such that the at least first electron emitter is symmetrically disposed within the aperture; and H) a gate electrode comprised of a second non-insulator layer substantially disposed on at least part of the at least second surface of the second insulator layer.

20. The controlled cold-cathode field-induced electron emission device of claim 19, further comprising an anode distally disposed with respect to the at least first electron emitter, for collecting at least some of the emitted electrons.

21. An electron emission device, wherein the electron emission device comprises an array of controlled cold-cathode field-induced electron emission devices (FEDs), the array comprising at least:

A) a supporting substrate with at least a first major surface;

B) at least a first current source substantially disposed in the supporting substrate;

C) a plurality of conductive lines, at least some of which are operably coupled to the at least first current source and are disposed on part of the at least first major surface of the supporting substrate;

D) a first insulator layer comprised of at least a first and a second surface, wherein at least part of the at least first surface of the first insulator layer is disposed on at least part of the at least first major surface of the supporting substrate, the first insulator layer having at least a first conductive path that is operably coupled to at least a first conductive line of the plurality of conductive lines and is disposed transversely through the said first insulator layer;

E) a non-insulator layer substantially disposed on at least part of the at least second surface of the first insulator layer and operably coupled to at least the first conductive path;

F) a plurality of electron emitters, for emitting electrons, each at least partially disposed on the non-insulator layer;

G) a second insulator layer comprised of at least a third and a fourth surface, the second insulator layer having a plurality of apertures substantially transversely disposed through the second insulator layer, wherein the at least first surface of the second insulator layer is at least partially disposed on the non-insulator layer and is positioned such that at least some of the plurality of electron emitters are substantially symmetrically disposed within at least some of the plurality of apertures; and H) a gate electrode comprised of a second conductive layer, substantially disposed on at least part of the at least second surface of the second insulator layer.

22. The controlled cold-cathode field-induced electron emission device of claim 21, further comprising an anode that is distally disposed with respect to the plurality of electron emitters, for collecting at least some of the emitted electrons.

23. An electron emission device, wherein the electron emission device is an array of controlled cold-cathode field-induced electron emission devices (FEDs), the array comprising at least:

A) a supporting substrate with at least a first major surface;

B) at least a first voltage source substantially disposed in the supporting substrate;

C) a plurality of conductive lines, at least some of which are operably coupled to the at least first voltage source and are disposed on part of the at least first major surface of the supporting substrate;

D) a first insulator layer comprised of at least a first and a second surface, wherein at least part of the at least first surface of the first insulator layer is disposed on at least part of the at least first major surface of the supporting substrate, the first insulator layer having at least a first conductive path that is operably coupled to at least a first of the plurality of conductive lines and is disposed transversely through the said first insulator layer;

E) a non-insulator layer substantially disposed on at least part of the at least second surface of the first insulator layer and operably coupled to at least the first conductive path;

F) a plurality of electron emitters, for emitting electrons, each at least partially disposed on the non-insulator layer;

G) a second insulator layer comprised of at least a third and a fourth surface, the second insulator having a plurality of apertures substantially transversely disposed through the second insulator layer, wherein the at least third surface of the second insulator layer is at least partially disposed on the non-insulator layer and is positioned such that at least some of the plurality of electron emitters are substantially symmetrically disposed within at least some of the plurality of apertures; and H) a gate electrode comprised of a second conductive layer substantially disposed on at least part of the at least second surface of the second insulator layer.

24. The controlled cold-cathode field-induced electron emission device of claim 23, and further comprising an anode, distally disposed with respect to the plurality of electron emitters for collecting at least some of the emitted electrons.

25. An electron emission device, wherein the electron emission device is an array of controlled cold-cathode field-induced electron emission devices (FEDs), the array comprising at least:

A) a supporting substrate with at least a first major surface;

B) a plurality of current sources substantially disposed in the supporting substrate;

C) a plurality of current source driver and select logic network means, for controlling each of the plurality of current sources, substantially disposed in the supporting substrate;

D) a plurality of conductive lines, at least some of which are operably coupled to at least some of the plurality of current sources and to at least some of the plurality of current source driver and select logic network means and are disposed on part of the at least first major surface of the supporting substrate;

E) a first insulator layer comprised of at least a first and a second surface, wherein at least part of the at least first surface of the first insulator layer is disposed on at least part of the at least first major surface of the supporting substrate, the first insulator layer having a plurality of conductive paths such that at least some of the conductive paths are operably coupled to at least a first conductive line of the plurality of conductive lines and are disposed transversely through the said first insulator layer;

F) a non-insulator layer substantially disposed on at least part of the at least second surface of the first insulator layer and operably coupled to at least some conductive paths of the plurality of conductive paths;

G) a plurality of electron emitters, for emitting electrons, each at least partially disposed on the non-insulator layer;

H) a second insulator layer comprised of at least a third and a fourth surface, the second insulator layer having a plurality of apertures substantially transversely disposed through the second insulator layer, wherein the at least first surface of the second insulator layer is at least partially disposed on the non-insulator layer and is positioned such that at least some of the plurality of electron emitters are substantially symmetrically disposed within at least some of the plurality of apertures; and I) a gate electrode comprised of a second conductive layer substantially disposed on at least part of the at least second surface of the second insulator layer.

26. The controlled cold-cathode field-induced electron emission device of claim 25, further comprising an anode, distally disposed with respect to the plurality of electron emitters, for collecting at least some of the emitted electrons.

27. An electron emission device, wherein the electron emission device is an array of controlled cold-cathode field-induced electron emission devices (FEDs), the array comprising at least:

A) a supporting substrate with at least a first major surface;

B) a plurality of voltage sources substantially disposed in the supporting substrate;

C) a plurality of voltage source driver and select logic network means for controlling each of the plurality of voltage sources, substantially disposed in the supporting substrate;

D) a plurality of conductive lines, at least some of which are operably coupled to at least some of the plurality of voltage sources and to at least some of the plurality of voltage source driver and select logic network means and are disposed on part of the at least first major surface of the supporting substrate;

E) a first insulator layer comprised of at least a first and a second surface, wherein at least part of the at least first surface of the first insulator layer is disposed on at least part of the at least first major surface of the supporting substrate, the first insulator layer having a plurality of conductive paths such that at least some of the conductive paths of the plurality of conductive paths are operably coupled to at least a first conductive line of the plurality of conductive lines and are disposed transversely through the said first insulator layer;

F) a non-insulator layer substantially disposed on at least part of the at least second surface of the first insulator layer and operably coupled to at least some of the conductive paths of the plurality of conductive paths;

G) a plurality of electron emitters, for emitting electrons, each at least partially disposed on the non-insulator layer;

H) a second insulator layer comprised of at least a third and a fourth surface and including a plurality of apertures, substantially transversely disposed through the second insulator layer wherein the first surface of the second insulator layer is at least partially disposed on the non-insulator layer, and is positioned such that at least some of the plurality of electron emitters are substantially symmetrically disposed within at least some of the plurality of apertures; and I) a gate electrode comprised of a second non-insulator layer substantially disposed on at least part of the at least second surface of the second insulator layer.

28. The controlled cold-cathode field-induced electron emission device of claim 27, further comprising an anode that is distally disposed with respect to the plurality of electron emitters, for collecting at least some of the emitted electrons.

29. An electron emission device, wherein the electron emission device is an array of controlled cold-cathode field-induced electron emission devices (FEDs), the array comprising at least:

A) a first non-insulator layer comprising a supporting substrate with at least a first major surface;

B) a plurality of insulator layers and a plurality of non-insulator layers, in addition to the supporting substrate, disposed on at least part of the at least first major surface of the supporting substrate such that each of the plurality of insulator layers and the plurality of non-insulator layers is substantially parallel planarly disposed and such that at least one of: a first layer of the plurality of insulator layers and a first layer of the plurality of non-insulator layers, further includes at least a first conductive path operably coupled to at least a first conductive line of a plurality of conductive lines, disposed substantially transversely through the at least first layer of the plurality of insulator layers;

C) a plurality of current sources each of which current sources is substantially disposed in at least the first layer of the plurality of non-insulator layers;

D) a plurality of current source driver and select logic networks, substantially disposed in the at least first layer of the plurality of non-insulator layers;

E) a plurality of electron emitters, for emitting electrons, each at least partially disposed on at least one of: the first layer of the plurality of insulator layers and the first layer of the plurality of non-insulator layers; and F) a gate electrode comprised of a non-insulator layer substantially disposed on at least part of a surface of an insulator layer of the plurality of insulator layers and non-insulator layers;

such that: at least some of the plurality of conductive lines operably coupled to at least some of the plurality of current sources and to at least some of the plurality of current source driver and select logic networks, and substantially disposed on part of a surface of at least one of: at least the first layer of the plurality of insulator layers and at least the first layer of the plurality of non-insulator layers; and such that at least one of: at least the first layer of the plurality of insulator layers and at least the first layer of the plurality of non-insulator layers, is comprised of at least a first and a second surface, the at least first layer of the plurality of insulator layers having a plurality of apertures that are substantially transversely disposed through the at least first insulator layer, positioned such that at least some of the plurality of electron emitters are substantially symmetrically disposed within at least some of the plurality of apertures.

30. The electron emission device of claim 29, further comprising an anode, distally disposed with respect to the electron emitters, for collecting at least some of the emitted electrons.

31. The electron emission device of claim 29, wherein at least some of the plurality of electron emitters are operably coupled to at least the first conductive path.

32. The electron emission device of claim 29, wherein at least the first conductive path is operably coupled to at least the first conductive line of the plurality of conductive lines.

33. The electron emission device of claim 29, wherein at least the first layer of the plurality of non-insulator layers is comprised of semi-conductor material.

34. The electron emission device of claim 29, wherein at least the first layer of the plurality of non-insulator layers is comprised of a metallic conductor.

35. The electron emission device of claim 29, wherein at least some of the conductive lines of the plurality of conductive lines are formed by ion implantation.

36. An electron emission device, wherein the electron emission device is an array of controlled cold-cathode fieldinduced electron emission devices (FEDs), the array comprising at least:

A) a first non-insulator layer comprising a supporting substrate with at least a first major surface;

B) a plurality of insulator layers and a plurality of non-insulator layers, in addition to the supporting substrate, disposed on at least part of the at least first major surface of the supporting substrate, wherein each of the plurality of insulator layers and the plurality of non-insulator layers is substantially parallel planarly dispoed and wherein at least one of: a first layer of the plurality of insulator layers and a first layer of the plurality of non-insulator layers, further includes at least a first conductive path operably coupled to at least a first conductive line of a plurality of conductive lines that are disposed substantially transversely through the at least one of the plurality of insulator layers;

C) a plurality of voltage source means, each of which voltage source means is substantially disposed in at least the first layer of the plurality of non-insulator layers;

D) a plurality of voltage source driver and select logic networks, operably coupled to at least some of the plurality of voltage source means, substantially disposed in at least the first layer of the plurality of non-insulator layers;

E) a plurality of electron emitters, for emitting electrons, each at least partially disposed on at least a layer of the plurality of insulator layers and non-insulator layers; and F) a gate electrode comprised of a non-insulator layer substantially disposed on at least a part of a surface of an insulator layer of the plurality of insulator layers and non-insulator layers;

such that at least some of the conductive lines of the plurality of conductive lines are operably coupled to at least some of the plurality of voltage source means, and at least some of the plurality of voltage source driver and select logic networks, and are disposed on a part of a surface of at least one of: at least the first layer of the plurality of insulator layers and at least the first layer of the plurality of non-insulator layers; and such that at least one of: at least the first layer of the plurality of insulator layers and at least the first layer of the plurality of non-insulator layers, is comprised of at least a first and a second surface, and includes a plurality of apertures, substantially transversely disposed through the at least first layer of the plurality of insulator layers, and is positioned such that at least some of the plurality of electron emitters are substantially symmetrically disposed within at least some of the plurality of apertures.

37. The controlled cold-cathode field-induced electron emission device of claim 36, further comprising an anode, distally disposed with respect to the electron emitters, for collecting at least some of the emitted electrons.

38. The electron emission device of claim 36, wherein at least some of the plurality of electron emitters are operably coupled to at least the first conductive path.

39. The electron emission device of claim 36, wherein at least the first conductive path is operably coupled to at least the first conductive line of the plurality of conductive lines.

40. The electron emission device of claim 36, wherein at least the first layer of the plurality of the non-insulator layers is comprised of semi-conductor material.

41. The electron emission device of claim 36, wherein at least the first layer of the plurality of the non-insulator layers is comprised of a metallic conductor.

42. The electron emission device of claim 36, wherein at least some of the conductive lines of the plurality of conductive lines are formed by ion implantation.

43. An electron emission device, wherein the electron emission device is an array of controlled cold-cathode fieldinduced electron emission devices (FEDs), the array comprising at least:

A) a first non-insulator layer comprising a supporting substrate with at least a first major surface;

B) a plurality of insulator layers and a plurality of non-insulator layers, in addition to the supporting substrate, disposed on at least part of the at least first major surface of the supporting substrate, wherein each of the plurality of insulator layers and the plurality of non-insulator layers is substantially parallel planarly disposed and wherein at least one of: the first layer of the plurality of insulator layers and the first layer of the plurality of non-insulator layers, further comprises at least a first conductive path operably coupled to at least a first conductive line of a plurality of conductive lines that are disposed substantially transversely through the at least one of the plurality of insulator layers;

C) at least a first voltage source means substantially disposed in at least the first layer of the plurality of non-insulator layers;

D) a plurality of current sources substantially disposed in at least the first layer of the plurality of non-insulator layers;

E) a plurality of current source driver and select logic networks, operably coupled to at least some of the plurality of current sources, substantially disposed in at least the first layer of the plurality of non-insulator layers;

F) a plurality of electron emitters, for emitting electrons, each at least partially disposed on at least a layer of the plurality of insulator layers and non-insulator layers; and G) a gate electrode comprised of a non-insulator layer substantially disposed on at least a part of a surface of an insulator layer of the plurality of insulator layers and noninsulator layers;

such that at least some of the plurality of conductive lines are operably coupled to at least the first of voltage source means and at least some of the plurality of voltage source driver and select logic networks, and disposed on a part of a surface of at least one of the plurality of insulator layers and non-insulator layers; and such that at least one of: at least the first layer of the plurality of insulator layers and at least the first layer of the plurality of non-insulator layers, is comprised of at least a first and a second surface, and includes a plurality of apertures, substantially transversely disposed through the at least first layer of the plurality of insulator layers, and is positioned such that at least some of the plurality of electron emitters are substantially symmetrically disposed within at least some of the plurality of apertures.

44. The controlled cold-cathode field-induced electron emission device of claim 43, further comprising an anode that is distally disposed with respect to the electron emitters, for collecting at least some of the emitted electrons.

45. The controlled cold-cathode field-induced electron emission device of claim 43, further comprising at least a first voltage source driver and select logic network operably coupled to the at least first voltage source.

46. The electron emission device of claim 43, wherein at least some of the plurality of electron emitters are operably coupled to at least the first conductive path.

47. The electron emission device of claim 43, wherein at least the first conductive path is operably coupled to at least the first conductive line of the plurality of conductive lines.

48. The electron emission device of claim 43, wherein at least the first layer of the plurality of non-insulator layers is comprised of semi-conductor material.

49. The electron emission device of claim 43, wherein at least the first layer of the plurality of non-insulator layers is comprised of a metallic conductor.

50. The electron emission device of claim 43, wherein at least some of the conductive lines of the plurality of conductive lines are formed by ion implantation.

51. An electron emission device, wherein the electron emission device is an array of controlled cold-cathode fieldinduced electron emission devices (FEDs), the array comprising at least:

A) a first non-insulator layer comprising a supporting substrate with at least a first major surface;

B) a plurality of insulator layers and a plurality of non-insulator layers, in addition to the supporting substrate, disposed on at least part of the at least first major surface of the supporting substrate, wherein each of the plurality of insulator layers and the plurality of non-insulator layers is substantially parallel planarly disposed and wherein at least one of: at least a first layer of the plurality of insulator layers and at least a first layer of the plurality of non-insulator layers, further includes a plurality of conductive paths operably coupled to at least a first conductive line of a plurality of conductive lines, and disposed substantially transversely through at least the first layer of the plurality of insulator layers;

C) at least a first voltage source substantially disposed in at least the first layer of the plurality of non-insulator layers;

D) a plurality of current sources substantially disposed in at least the first layer of the plurality of non-insulator layers;

E) a plurality of current source driver and select logic networks, operably coupled to at least some of the plurality of current sources, and substantially disposed in at least the first layer of the plurality of non-insulator layers;

F) a plurality of electron emitters, for emitting electrons, each at least partially disposed on at least a layer of the plurality of insulator layers and non-insulator layers; and G) a plurality of gate electrodes comprised of a selectively patterned non-insulator layer substantially disposed on at least a part of a surface of an insulator layer of the plurality of insulator layers and non-insulator layers;

such that at least some of the plurality of conductive lines are operably coupled to at least some of the plurality of current sources and at least some of the plurality of current source driver and select logic networks, and are disposed on part of a surface of at least one of: at least the first layer of the plurality of insulator layers and at least the first layer of the plurality of non-insulator layers; and such that at least one of: at least the first layer of the plurality of insulator layers and at least the first layer of the plurality of non-insulator layers, is comprised of at least a first and a second surface, and includes a plurality of apertures that are substantially transversely disposed through the at least first layer of the plurality of insulator layers, and that are positioned such that at least some of the plurality of electron emitters are substantially symmetrically disposed within at least some of the plurality of apertures.

52. The electron emission device of claim 51, further comprising an anode that is distally disposed with respect to the electron emitters, for collecting at least some of the emitted electrons.

53. The electron emission device of claim 51, further comprising at least a first voltage source driver and select logic network operably coupled to the at least first voltage source.

54. The electron emission device of claim 53, wherein the at least first voltage source driver and select logic network is selectively independently operably coupled to at least some of the plurality of conductive lines.

55. The electron emission device of claim 51, wherein at least some of the plurality of electron emitters are operably coupled to at least the first conductive path.

56. The electron emission device of claim 51, wherein at least some of the plurality of gate electrodes are operably coupled to at least some of the plurality of conductive paths.

57. The electron emission device of claim 51, wherein at least the first layer of the plurality of non-insulator layers is comprised of semi-conductor material.

58. The electron emission device of claim 51, wherein at least the first layer of the plurality of non-insulator layers is comprised of a metallic conductor.

59. The electron emission device of claim 51, wherein at least some of the conductive lines of the plurality of conductive lines are formed by ion implantation.

* * * * *